United States Patent [19]

Diamond

[11] 4,221,336

[45] Sep. 9, 1980

[54] NOZZLE WITH DIRECTIONALLY VARIABLE OUTLET

[76] Inventor: Harvey E. Diamond, 12953 Woodbridge St., Studio City, Calif. 91604

[21] Appl. No.: 956,372

[22] Filed: Oct. 31, 1978

[51] Int. Cl.[3] ..... E03C 1/08

[52] U.S. Cl. ..... 239/428.5; 239/587; 239/600; 285/269; 285/271

[58] Field of Search ..... 239/587, 589, 596, 600, 239/428.5; 285/269, 271

[56] References Cited

U.S. PATENT DOCUMENTS

| | | | |
|---|---|---|---|
| 1,056,811 | 3/1913 | McElroy | 239/587 X |
| 3,677,474 | 7/1972 | Lorenzen | 239/587 |
| 3,985,303 | 10/1976 | Steimle | 285/271 X |
| 3,997,116 | 12/1976 | Moen | 239/587 X |

*Primary Examiner*—Richard A. Schacher
*Attorney, Agent, or Firm*—I. Morley Drucker

[57] ABSTRACT

An angularly adjustable liquid outlet nozzle for directing a stream of fluid under pressure into a body of fluid has a unitary body with an inlet opening at one end communicating with a mixing chamber through a venturi air inlet, and an outlet opening at the other end in which is seated a directional ball outlet between a pair of low friction bearing and sealing rings. A spring maintains a sealing engagement between the low friction rings and the ball outlet so that the latter may be directionally adjusted without interrupting the seal.

13 Claims, 6 Drawing Figures

NOZZLE WITH DIRECTIONALLY VARIABLE OUTLET

BACKGROUND OF THE INVENTION

The invention relates generally to outlet nozzles for fluids and, in particular, to directionally adjustable nozzles used to direct a stream of fluid under pressure, at precise, variable, angles. The nozzle of this invention has application in many fields and is particularly adapted for use as an outlet in therapeutic baths.

BRIEF DESCRIPTION OF THE PRIOR ART

Previous units of this type have been of complex design, requiring the assembly of many parts, such as the device disclosed in U.S. Pat. No. 3,677,474 entitled "ADJUSTABLE LIQUID DISCHARGE JET".

SUMMARY OF THE INVENTION

The present invention is directed towards an angularly adjustable liquid outlet nozzle for directing a stream of fluid under pressure into a bath or vessel containing a body of fluid, e.g., water. The nozzle is preferably mounted on a vessel wall at a point below the surface level of the fluid contained therein and the angle of discharge is readily adjusted externally of the nozzle simply by manual means.

Specifically, the invention disclosed herein is directed towards an adjustable nozzle of simplified construction, comprising a unitary nozzle body adapted to be mounted onto a container wall, the body being provided with suitable fluid inlet openings communicating with a mixing chamber. The nozzle body also defines a cavity at its outlet end in communication with the mixing chamber. A directional ball outlet, preferably of segmented spherical shape, is substantially contained within the cavity and is preferably seated between a first, low-friction, bearing ring and a second, low-friction, sealing ring provided near each end of the cavity. Each of the rings is preferably made of a smooth, low friction material, such as tetrafluorethylene polymer (e.g., Teflon®), to enable ready rotation of the ball outlet to a wide range of desired angular positions. A spring means is included in said cavity and biases said first bearing ring against the outer surface of the directional ball outlet thereby urging said ball outlet into rotatable sealing engagement with the second sealing ring.

Because of the unitary design of the nozzle body, it is necessary to provide integral means for inserting the rotatable ball outlet into the cavity provided therefor and also to provide means for retaining the ball outlet within the cavity. For this purpose, the outer end of the ball outlet cavity is preferably provided with flange portions which define a keyway. The ball outlet has a spherically segmented shape and is dimensioned so as to be readily inserted within the keyway. After insertion, the ball outlet is then rotated so that the spherical surfaces thereof are retained by the flanges defining the keyway. An alternate embodiment of the invention is provided with a circular flange at the mouth of the cavity of slightly reduced diameter with respect to the ball outlet whereby the ball outlet is press fitted into said cavity during assembly of the unit and retained therein by the same circular flange.

The adjustable nozzle of the present invention is of simpler and more economical design than those of which we have knowledge, and has other advantages which will become apparent from the detailed descriptions and drawings contained herein.

DESCRIPTION OF THE PREFERRED EMBODIMENT

Figure 1:
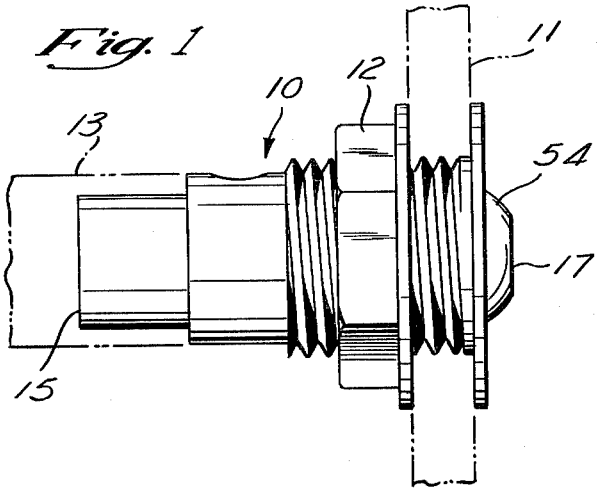
FIG. 1 is a side, elevational, view of a preferred embodiment of the nozzle of the present invention, the phantom line depicting a typical installation.

Referring to FIG. 1, the nozzle 10 of the present invention is shown mounted within a container wall 11. The nozzle 10 has a partially threaded body 20 and is retained, on the wall 10 by an internally threaded retaining nut 12. Fluid is delivered to the nozzle 10 through a conventional conduit 13, shown in phantom line. The inlet end of the nozzle 10 is designated by the numeral 15 and the nozzle outlet end is designated by the numeral 17.

Figure 2:
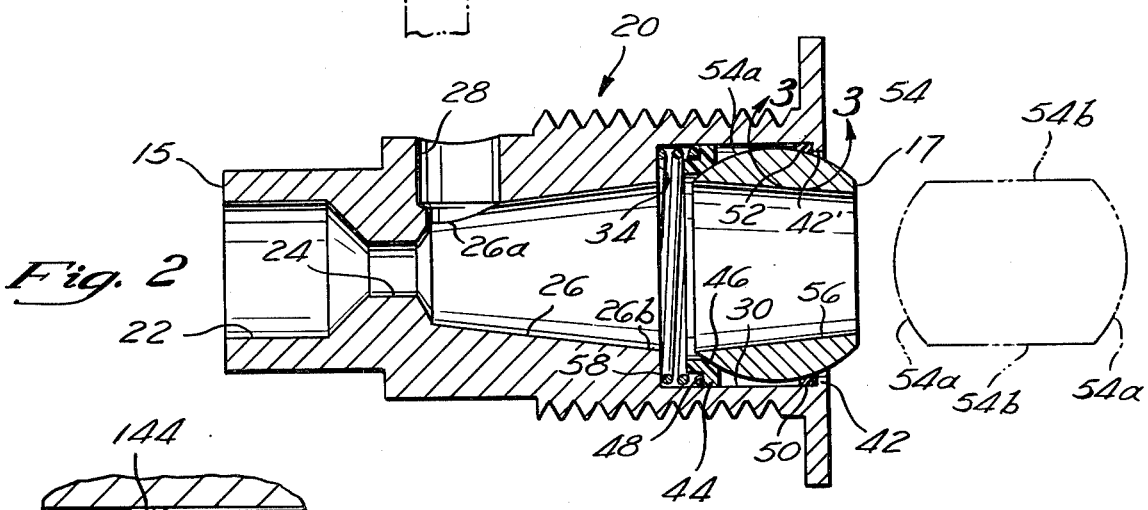
FIG. 2 is an axial cross section of the embodiment of FIG. 1. Shown in dotted lines is the ball outlet of the nozzle positioned for assembly into the nozzle body.

Referring now to FIG. 2, as well as FIG. 1, the nozzle 10 comprises a unitary nozzle body 20 which is formed from a single block of material, preferably of a non-corrosive metal, such as brass, bronze or plastic. The unitary nozzle body 20 has formed therewithin, and defines, a cylindrical fluid flow inlet passage 22, the leading, or exit, end of which narrows to a throat passage or portion 24 of restricted aperture relative to the diameter of inlet passage 22. The throat passage 24 opens into a frusto-conical chamber 26 of the venturi type. The nozzle body 20 is also preferably provided with a separate air inlet passage 28. Air inlet passage 28 is preferably formed with its axis at right angles to the axis of the chamber 26 and intersects with the axis of chamber 26 at the constricted end thereof **26*a*, i.e., near the terminus of throat passage 24**.

This arrangement of air and water inlets 28 and 22, respectively, enables efficient mixing and agitation of air and liquid to take place within venturi chamber 26.

The nozzle body 20 defines, at the outlet side thereof, a cylindrical bore or cavity 30 of slightly enlarged diameter with respect to the diameter of outlet end **26*b* of venturi chamber 26. The chamber 26 is in direct communication with cavity 30**.

The cavity 30 is provided with a ball outlet 54 having a spherically segmented external surface **54*a* and an internal axially directed forwardly tapering fluid flow channel 56 formed therein. The ball outlet 54 is rotatably mounted within cavity 30, preferably between a pair of smooth, low friction, bearing rings 44, 50** to achieve precise angular direction, as will now be specifically described.

Specifically, a first circumferential bearing ring 44 is mounted near the inner or trailing end of cavity 30. The ring 44 is formed on its non-bearing surface with an L-shaped cross-section providing a circumferential retaining shoulder 48 against which one end of a helical compression spring 58 is seated. The other end of spring 58 abuts a circumferential shoulder 34 formed at the intersection of cavity 30 and outlet end 26*a* of chamber 26. Spring 58 thus urges low-friction ring 44 into circumferential bearing engagement with a circumferential portion of the external surface 54*a* of ball outlet 54. In addition, a second, low friction, circumferential ring 50 is placed near the outer end of the cavity 30 and is retained against flanges 42, 42' formed at the exit end of the nozzle body 20 under the influence of helical spring 58. Rings 44 and 50 are each preferably made of a smooth, very low-friction material, e.g., polytetrafluoroethylene (PTFE) thus presenting very low friction bearing surfaces to ball outlet 54 and enabling ball outlet 54 to be easily rotated to a precise angular direction between the rings 44 and 50.

Figure 6:
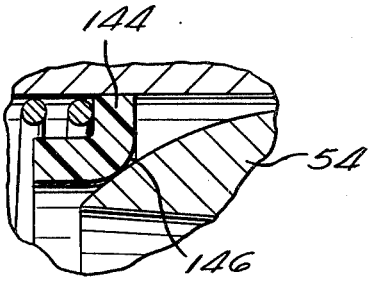
FIG. 6 is a partial cross-sectional view of an alternative form of an inner bearing ring of the invention.

Outer ring 50 is preferably formed with a concave ball outlet bearing surface 52. Inner ring 44 may also be similarly formed with a concave ball outlet bearing surface 46 as shown in FIG. 2. Alternatively, the inner ring 44 may be formed with a convex ball outlet bearing surface as shown in the alternative embodiment of FIG. 6. The inner ring, there designated by numeral 144, is provided with a convex bearing surface 146.

Figure 3:
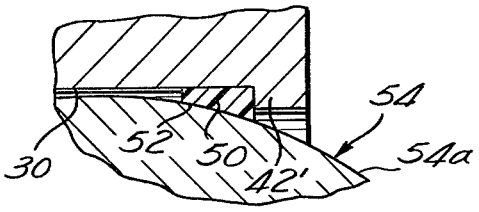
FIG. 3 is an enlarged detail, taken along arcuate line 3—3 of FIG. 2.

It will be noted that the spring means 58 shown in FIG. 2 is normally compressed between the nozzle body shoulder 34 and circumferential surface 48 of inner bearing ring 44, thereby biasing said ring 44 so that the ring bearing surface 46 engages the spherical surface 54*a* of ball outlet 54, and urges the ball outlet into rotatable sealing engagement with concave bearing surface 52 of second ring 50, as shown in enlarged detail in FIG. 3.

Figure 5:
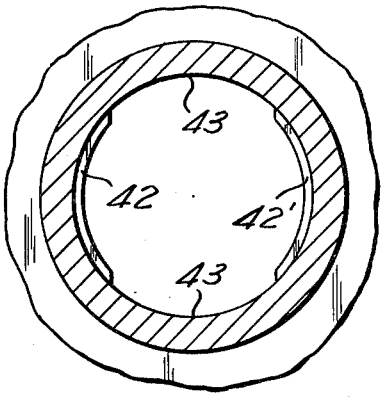
FIG. 5 is a partial cross-sectional view taken along the line 5—5 of FIG. 4.
Figure 4:
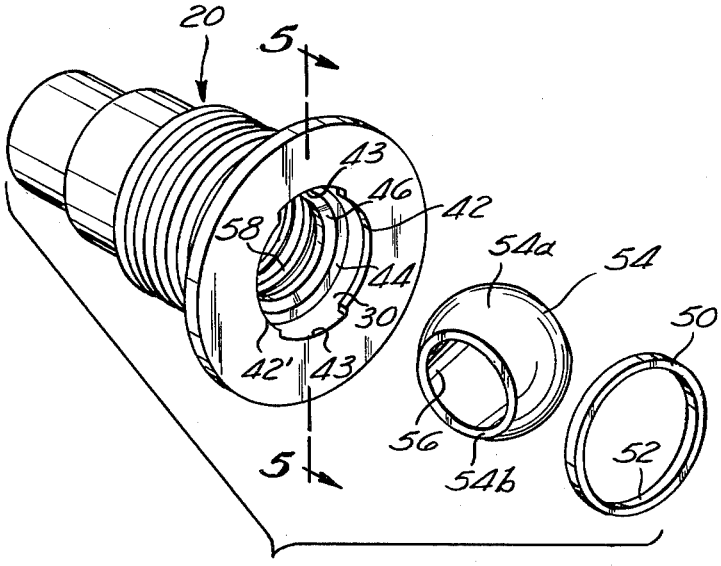
FIG. 4 is a partially exploded perspective view of the embodiment of FIG. 1.

Assembly of the ball outlet 54 into the unitary body 20 will now be described. It will be noted that flanges 42, 42' formed at the mouth, or outer end, of cavity 30 define a keyway 43, (see FIGS. 4 & 5) of greater length than the length between flanges 42, 42'. The ball outlet 54, being of spherically segmented shape, is readily inserted into cavity 30, via keyway 43, with the spherical surface 54*a* of ball outlet 54 in alignment with the keyway 43. In this alignment, and as shown in FIGS. 2 and 4, the parallel edges 54*b* of ball outlet 54 are generally vertical and readily pass between flanges 42, 42' of cavity 30. Ball outlet 54 is then pressed against spring biased ring 44 thus compressing spring means 58.

Once the point of maximum diameter of said ball outlet 54 is within cavity 30, the ball outlet is rotated so that its major axis is approximately aligned with the axis of cavity 30 so as to be retained by flanges 42 and 42'.

The second ring 50 is then mounted within cavity 30 between ball outlet 54 and said flanges 42 and 42', thus obstructing keyway 43 and retaining said ball outlet 54 within said cavity 30 regardless of the relative position of the ball outlet 54 in said cavity 30.

In an alternate embodiment of the present invention (not shown in the drawings), flanges 42 and 42' are replaced by a single circumferential flange, not having a keyway 43, said circumferential flange being of slightly reduced diameter with respect to the maximum outer diameter of ball outlet 54. Ball outlet 54 is then press-fitted into cavity 30 through the central opening defined by the circumferential flange and is retained therein by the same flange. As in the preferred embodiment of the preceding paragraph, second ring 50 is mounted in cavity 30 between the ball outlet and said circumferential flange, after said ball outlet is placed within cavity 30.

First and second rings 44 and 50, respectively, are preferably made of a material that will present smooth, low friction surfaces to permit easy rotation of ball outlet 54 while maintaining firm contact with the same and without breaking the seal of second ring 50 with said ball outlet 54. In the preferred embodiment rings 44 and 50 are made of tetrafluoroethylene polymer (e.g., Teflon®), a material having the required properties as well as being resistant to corrosion.

While first and second separable rings have been shown as low friction bearing elements, the invention includes bearing elements in the form of Teflon®-coated springs and Teflon®-coated cavity 30 or flanges 42, 42' (not shown) as alternative embodiments.

The present invention is of simple and economical design, greatly reducing the number of parts incorporated in the adjustable nozzle, with consequent savings of labor and time required for assembly of the unit and without compromise of utility or efficiency. The reduced number of parts also results in a more reliable and longer lasting nozzle device. These and other advantages will be appreciated by those skilled in the art from the present specification.

While in the foregoing description the preferred and alternate embodiments of the invention has been set forth for purposes of explanation, it will be understood that many variations and changes may be made without departing from the spirit and scope of the invention.

I claim:

1. An adjustable nozzle comprising:

a rigid unitary body provided with fluid inlet means communicating with a cavity at one end of said unitary body, said cavity having an outer end;

flange means integral with said rigid unitary body at said outer end defining an opening into said cavity;

a first bearing element contained within said cavity;

a directional ball outlet of slightly greater maximum outer diameter than said opening whereby said ball outlet is mounted within said cavity by means of a press-fit between said ball outlet and said opening;

a ring shaped second bearing element having a low-friction internal bearing surface interposed between said ball outlet and said flange means; and spring means biasing said first bearing element against said ball outlet to urge said directional ball outlet into rotatable sealing engagement with said internal bearing surface of second bearing element.

2. The adjustable nozzle of claim 1 wherein said fluid inlet means includes a fluid inlet having a throat portion of restricted aperture with respect to the inner diameter of said ball outlet.

3. The adjustable nozzle of claim 1 wherein said fluid inlet means includes a throat portion of restricted aperture in communication with said ball outlet.

4. The adjustable nozzle of claim 1 wherein said first bearing has a smooth, low-friction, convex bearing surface against which said ball outlet bears.

5. The adjustable nozzle of claim 1 wherein said second bearing element has a smooth, low friction, concave bearing surface against which said ball outlet bears in a rotatably sealing engagement.

6. The adjustable nozzle of claim 1 wherein said fluid inlet means includes a water inlet, a separate air inlet, and a mixing chamber with which said water and inlets communicate.

7. The adjustable nozzle of claim 1 wherein said ball outlet comprises a segmented spherical body having an opening extending axially therethrough.

8. The adjustable nozzle of claim 1 wherein said first bearing has a smooth, low-friction convex bearing surface against which said ball outlet bears, and said second ring has a smooth, low friction, concave bearing surface against which said ball outlet bears in rotatably sealing engagement.

9. An adjustable nozzle comprising:

a unitary body provided with fluid inlet means communicating with a cavity at one end of said unitary body, said cavity having an outer end;

a first bearing element contained within said cavity;

a second bearing element contained in the vicinity of the outer end of said cavity;

a directional ball outlet;

a spring means biasing said first bearing element against said ball outlet to urge said directional ball outlet into rotatable sealing engagement with said second bearing element; and said cavity being provided in the vicinity of the outer end thereof with flange portions defining a keyway for insertion of said ball outlet through said keyway into said cavity and for retention thereof by said flange portions.

10. The adjustable nozzle of claim 9 wherein said fluid inlet means includes a water inlet, a separate air inlet, and a mixing chamber, with which said water and air inlets communicate.

11. An adjustable nozzle comprising:

a unitary body provided with fluid inlet means communicating with a cavity at one end of said unitary body, said cavity having an outer end;

a first bearing element contained within said cavity;

a second bearing element contained in the vicinity of the outer end of said cavity;

a directional ball outlet having a spherically segmented surface;

a spring means biasing said first bearing element against said ball outlet to urge said directional ball outlet into rotatable sealing engagement with said second bearing element; and said cavity being provided in the vicinity of the outer end thereof with flange portions defining a keyway for insertion of said ball outlet through said keyway into said cavity and for retention thereof by said flange portions upon rotation of said ball outlet.

12. An adjustable nozzle comprising:

a unitary body;

a cavity defined within said unitary body at one end thereof, said cavity having an inner end and an outer end;

a directional ball outlet;

a first ring contained near the end of said cavity, said first ring having a smooth, low-friction, bearing surface against which said ball outlet bears;

a second ring mounted in the vicinity of the outer end of said cavity, said second ring having a smooth, low-friction bearing surface;

a spring means contained within said unitary body, biasing said first ring against said ball outlet to urge said ball outlet into rotatable sealing engagement with said bearing surface of said second ring; and said cavity being provided in the vicinity of the outer end thereof with flange portions defining a keyway for insertion of said ball outlet through said keyway into said cavity for retention thereof by said flange portions.

13. An adjustable nozzle comprising:

a unitary body;

a cavity defined within said unitary body at one end thereof, said cavity having an inner end and an outer end;

a directional ball outlet having a spherically segmented surface;

a first ring contained near the end of said cavity, said first ring having a smooth, low-friction, bearing surface against which said ball outlet bears;

a second ring mounted in the vicinity of the outer end of said cavity, said second ring having a smooth, low-friction bearing surface;

a spring means contained within said unitary body, biasing said first ring against said ball outlet to urge said ball outlet into rotatable sealing engagement with said bearing surface of said second ring; and said cavity being provided in the vicinity of the outer end thereof with flange portions defining a keyway for insertion of said ball outlet through said keyway into said cavity for retention thereof by said flange portions upon rotation of said ball outlet.

* * * * *